US007956741B2

(12) United States Patent
Tamezane et al.

(10) Patent No.: US 7,956,741 B2
(45) Date of Patent: Jun. 7, 2011

(54) TUMBLER TYPE LOCK APPARATUS

(75) Inventors: Takumi Tamezane, Aichi (JP); Toshiharu Katagiri, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 275 days.

(21) Appl. No.: 12/244,479

(22) Filed: Oct. 2, 2008

(65) Prior Publication Data

US 2009/0091434 A1 Apr. 9, 2009

(30) Foreign Application Priority Data

Oct. 4, 2007 (JP) ..... 2007-261269

(51) Int. Cl.
*E05B 45/06* (2006.01)

(52) U.S. Cl. ..... 340/542; 340/541; 340/426.1; 340/5.61; 340/5.73; 340/5.7; 70/262; 70/348; 70/373; 70/377; 70/387; 70/392; 70/492

(58) Field of Classification Search ..... 340/542, 340/541, 426.6, 5.61, 5.73, 5.7; 70/262, 70/348, 373, 377, 387, 392, 492
See application file for complete search history.

(56) References Cited

U.S. PATENT DOCUMENTS

| | | | | | |
|---|---|---|---|---|---|
| 4,149,394 | A | * | 4/1979 | Sornes | 70/352 |
| 5,025,647 | A | * | 6/1991 | Muus | 70/352 |
| 5,181,407 | A | * | 1/1993 | Wu | 70/361 |
| 5,961,816 | A | * | 10/1999 | Benazzi et al. | 208/111.3 |
| 5,986,564 | A | * | 11/1999 | Fraser | 340/5.6 |

FOREIGN PATENT DOCUMENTS

| | | |
|---|---|---|
| JP | 3090369 | 12/2002 |
| JP | 2004-076375 | 3/2004 |

* cited by examiner

*Primary Examiner* — Tai T Nguyen
(74) *Attorney, Agent, or Firm* — Patterson Thuente Christensen Pedersen, P.A.

(57) ABSTRACT

A tumbler-type lock apparatus for use with a tumbler-type card key having a code pattern region including an array of holes and non-hole portions that expresses a key code of the tumbler-type card key. The tumbler-type lock apparatus includes a slider case and a slider movable relative to the slider case when the tumbler-type card key is inserted into the tumbler-type lock apparatus. Tumblers extending in the slider case and slider each correspond to one of the holes or non-hole portions. Springs bias the tumblers towards the slider. The tumbler-type lock apparatus verifies the tumbler-type card key when the tumblers are engaged with the slider case and slider during insertion of the tumbler-type card key. The slider includes accommodation portions. A distal end of the tumbler that has passed through the corresponding hole of the tumbler-type card key is accommodated in the corresponding accommodation portion.

7 Claims, 8 Drawing Sheets

TUMBLER TYPE LOCK APPARATUS

CROSS-REFERENCE TO RELATED APPLICATIONS

This application is based upon and claims the benefit of priority from prior Japanese Patent Application No. 2007-261269, filed on Oct. 4, 2007, the entire contents of which are incorporated herein by reference.

BACKGROUND OF THE INVENTION

The present invention relates to a tumbler-type lock apparatus for use with a tumbler-type key including a code pattern region having an array of holes that expresses a key code, in which the lock apparatus verifies the key code.

In the prior art, various types of key systems are used to prevent unauthorized use of articles, doors, and the like by a third person. A typical key system uses a key that includes a grip and an elongated key plate (also referred to as key blade), which has an engraved key code. Insertion of the key plate into a cylinder of a lock apparatus aligns the engraved key code with a plurality of disk tumblers (small steel pieces), which are biased by a spring arranged in the cylinder. Rotation of the cylinder with the key is permitted when the key code of the key plate matches a key shape formed by the disk tumblers. In such a case, the opening and closing of the lock apparatus is enabled.

Patent document 1 and patent document 2 describe examples of a card key system using a card key. FIG. 12 depicts a card key system 81. The card key system 81 includes a card key 82 and a lock apparatus 86. The card key 82 has a code region 83 including an array of holes 84 that expresses a key code.

FIG. 13 depicts the lock apparatus 86 (also referred to as fixed component) in a state in which the card key 82 is not inserted therein. The lock apparatus 86 includes a supporting component 90 and a movable component 88 supported by the supporting component 90. The movable component 88 moves relative to the supporting component 90 when the card key 82 is inserted into the lock apparatus 86 to perform a key operation. The movable component 88 and the supporting component 90 may be referred to as the movable side and fixed side, respectively. A plurality of pin tumblers 87 are arranged so as to extend in the movable component 88 and the supporting component 90. Each pin tumbler 87 includes a lock pin 89 accommodated in the movable component 88 and a plunger pin 91 accommodated in the supporting component 90. The plunger pin 91 is biased towards the lock pin 89 by a tumbler spring 92. The plurality of pin tumblers 87 include first pin tumblers 87*a* and second pin tumblers 87*b*. In each first pin tumbler 87*a*, the plunger pin 91 is engaged with both of the movable component 88 and the supporting component 90 when the card key 82 is not inserted to the lock apparatus 86. In each second pin tumbler 87*b*, a shear line between the lock pin 89 and the plunger pin 91 is aligned with a shear line between the movable component 88 and the supporting component 90 when the card key 82 is not inserted into the lock apparatus 86.

As illustrated in FIG. 14, when the proper card key 82 is inserted into the lock apparatus 86, the shear line between the lock pin 89 and the plunger pin 91 is aligned with the shear line between the movable component 88 and the supporting component 90 in each of the pin tumblers 87 (first pin tumblers 87*a* and second pin tumblers 87*b*). This permits movement of the movable component 88 with respect to the supporting component 90 so that closing and opening of the lock apparatus 86 becomes possible.

As illustrated in FIG. 15, if the card key 82 inserted to the lock apparatus 86 is an improper key, the holes 84 of the card key 82 may be aligned with the first pin tumblers 87*a*, and the second pin tumblers 87*b* may be aligned with a non-hole region 85 of the card key 82. In such a first pin tumbler 87*a*, the plunger pin 91 may be lowered by the amount the distal end of the lock pin 89 is accommodated in the hole 84. Thus, the plunger pin 91 would be engaged with both of the movable component 88 and the supporting component 90. In such a second pin tumbler 87*b*, the distal end of the lock pin 89 may be lifted by the non-hole region 85 of the card key 82. Thus, the lock pin 89 would be engaged with both of the movable component 88 and the supporting component 90. As a result, the pin tumblers 87 prohibit movement of the movable component 88 relative to the supporting component 90. Thus, the opening and closing of the lock apparatus 86 cannot be performed with the improper key.

[Patent Document 1] Japanese Utility Model Registration No. 3090369

[Patent document 2] Japanese Laid-Open Patent Publication No. 2004-76375

SUMMARY OF THE INVENTION

Each pin tumbler 87 is moved upward or downward by an amount corresponding to the thickness of the card key 82 when the card key 82 is inserted into or removed from the lock apparatus 86. The distance of the upward and downward movement of the pin tumbler 87 is small if the card key 82 is thin.

The present invention provides a tumbler-type lock apparatus in which the pin tumblers are engaged with the movable component and the supporting component over a longer distance (i.e., the pin tumblers have an increased engagement length K).

The present invention also provides a vehicle antitheft device including an electronic key system and a tumbler-type lock apparatus used during emergencies.

One aspect of the present invention is a tumbler-type lock apparatus for use with a tumbler-type key having a code pattern region including an array of one or more holes and one or more non-hole portions that expresses a key code of the tumbler-type key. The tumbler-type lock apparatus includes a support member; a movable member movable relative to the support member when a proper tumbler-type key is inserted into the tumbler-type lock apparatus; a plurality of tumblers arranged to extend in the support member and the movable member. The plurality of tumblers each correspond to one of the one or more holes or one of one or more non-hole portions during insertion of the proper tumbler-type key. A plurality of biasing members each bias a corresponding one of the plurality of tumblers towards the movable member. The tumbler-type lock apparatus performs verification of the tumbler-type key based on whether the plurality of tumblers are engaged with the support member and the movable member during insertion of the tumbler-type key. The movable member or the support member includes an accommodation portion for accommodating a distal end of each tumbler that has passed through the corresponding hole of the tumbler-type key.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A tumbler-type lock apparatus according to a preferred embodiment of the present invention will be discussed.

Figure 1:
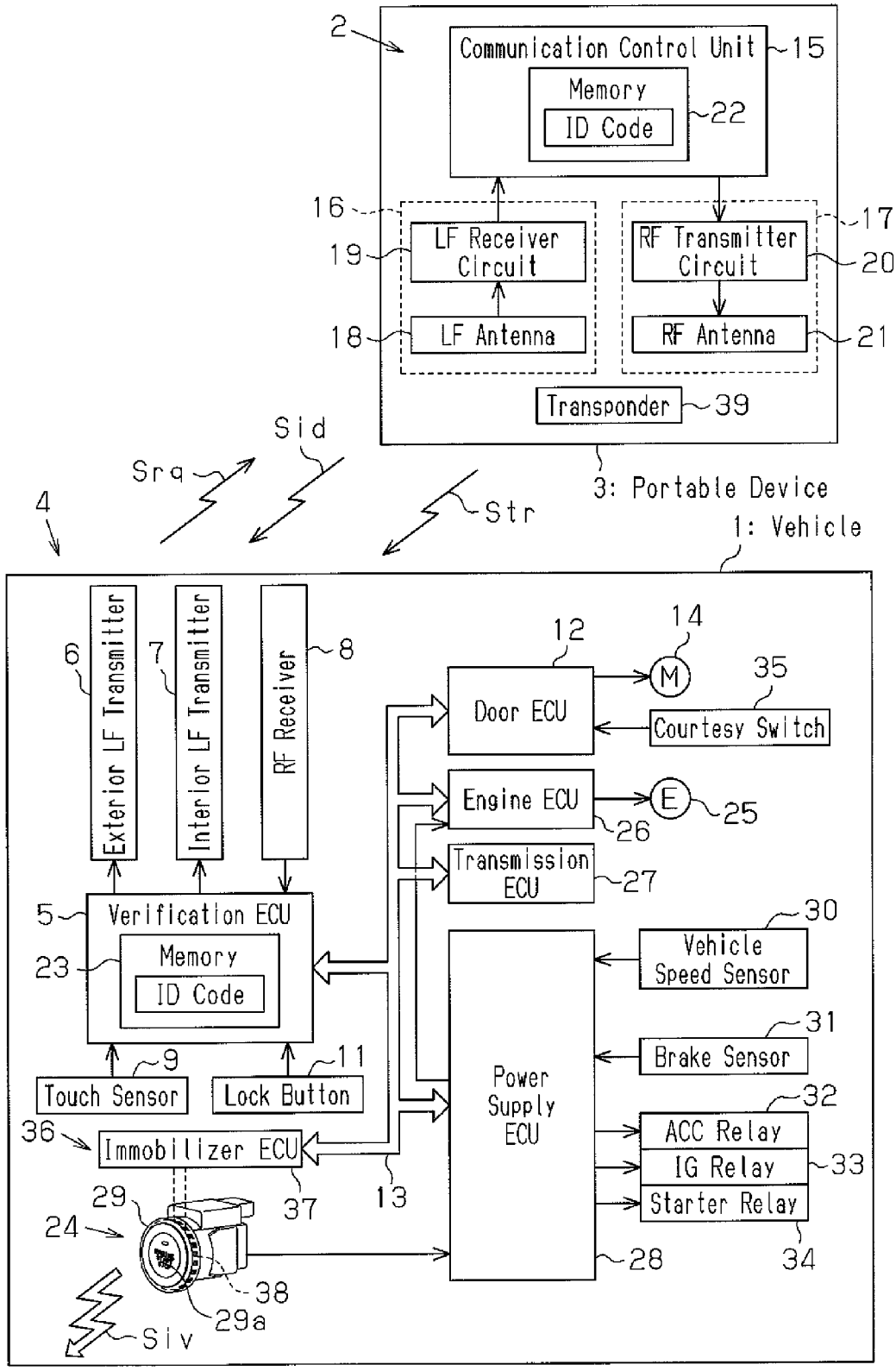
FIG. 1 is a block diagram of a key operation-free system.

As illustrated in FIG. 1, a vehicle 1 incorporates a key operation-free system 2 that performs vehicle operations including the locking and unlocking of the doors and the starting and stopping of the engine start/stop without physically operating a vehicle key. The key operation-free system 2 uses a vehicle key (hereinafter referred to as portable device 3) that transmits a unique ID code (key code) through wireless communication. In the key operation-free system 2, the vehicle 1 transmits a request signal Srq requesting the ID code. The portable device 3 returns an ID signal Sid including the ID code to the vehicle 1 through narrow-band wireless communication in response to the request signal Srq. If the ID code of the portable device 3 matches an ID code of the vehicle 1, the key operation-free system 2 enables the locking and unlocking of the door and the starting and stopping of the engine. The key operation-free system 2 is one example of an electronic key system, and the portable device 3 is one example of an electronic key.

The key operation-free system 2 incorporates a smart entry system 4 that locks and unlocks the doors without any physical operation of the vehicle key. The smart entry system 4 will now be described. The vehicle 1 includes a verification ECU 5 for verifying the ID code of the portable device 3 in the ID signal Sid received through narrow-band wireless communication. The verification ECU 5 is connected to a vehicle exterior LF transmitter 6, a vehicle interior LF transmitter 7, and an RF receiver 8. The vehicle exterior LF transmitter 6 is arranged in each door of the vehicle 1 to transmit a long frequency (LF band) signal out of the vehicle through wireless communication. The vehicle interior LF transmitter 7 is arranged in the vehicle (e.g., in the floor etc.) to transmit a LF band signal within the vehicle through wireless communication. The RF receiver 8 is arranged in the vehicle (e.g., in the rearview mirror etc.) to receive an RF band signal through wireless communication. The LF transmitters 6 and 7 transmit the request signal Srq through wireless communication. Specifically, the vehicle exterior LF transmitter 6 forms a communication area (vehicle exterior communication area) for the request signal Srq around the vehicle. The vehicle interior LF transmitter 7 forms a communication area (vehicle interior communication area) for the request signal Srq throughout the entire vehicle interior.

The verification ECU 5 is connected to a touch sensor 9 arranged, for example, in a door handle at the outer side of the vehicle. The touch sensor 9 detects a person touching the door handle 10 when the door is locked to unlock the door. The verification ECU 5 is connected to a lock button 11 arranged in, for example, the door handle 10. The lock button 11 is pushed to lock the unlocked door. The verification ECU 5 is connected to a door ECU 12, which controls the locking and unlocking of the door though an in-vehicle LAN 13. The door ECU 12 locks or unlocks the door by driving a door lock motor 14 in accordance with a command from the verification ECU 5.

The portable device 3 includes a communication control unit 15 for controlling wireless communication that is performed with the vehicle 1. The communication control unit 15 is connected to an LF reception unit 16, which receives an LF band signal, and an RF transmission unit 17, which transmits an RF band signal in accordance with a command from the communication control unit 15. The LF reception unit 16 demodulates an LF band signal, which is received by an LF reception antenna 18 in an LF receiver circuit 19, and provides the demodulated signal to the communication control unit 15 as received data. The RF transmission unit 17 modulates transmission data provided from the communication control unit 15 with an RF transmitter circuit 20, generates the ID signal Sid in the RF band with the unique ID code of the portable device 3, and transmits the ID signal Sid from an RF transmission antenna 21.

When the vehicle 1 is in a parked state (engine stopped and doors locked), the verification ECU 5 intermittently transmits the request signal Srq in the LF band to the vehicle exterior LF transmitter 6 and forms the vehicle exterior communication area around the vehicle. When the portable device 3 enters the vehicle exterior communication area and receives the request signal Srq with the LF reception unit 16, the portable device 3 transmits the ID signal Sid containing the ID code registered in a memory 22 to the RF transmission unit 17 as the RF band wireless signal in response to the request signal Srq. In the verification ECU 5, the ID code of the portable device 3 contained in the ID signal Sid and received by the RF receiver 8 is verified with the ID code registered in a memory 23 (vehicle exterior verification). When the vehicle exterior verification is completed, the verification ECU 5 sets a vehicle exterior verification flag in the memory 23 over a fixed time period and activates the touch sensor 9 in a standby state during that time period. When the activated touch sensor 9 detects that the vehicle exterior door handle has been touched, the door ECU 12 unlocks the locked door by generating rotation with the door lock motor 14 in one direction.

In a state in which the vehicle 1 is not moving (engine stopped and door unlocked), the verification ECU 5 transmits the request signal Srq to the vehicle exterior LF transmitter 6 when detecting that the lock button 11 has been pushed. The verification ECU 5 performs the vehicle exterior verification on the ID signal Sid returned from the portable device 3 in response to the request signal Srq. The verification ECU 5 provides a door lock request to the door ECU 12 when the vehicle exterior verification is completed. The door ECU 12 locks the unlocked door by generating rotation with the door lock motor 14 in the other direction in response to the door lock request.

The key operation-free system 2 includes a one-push engine start system 24 enabling the starting and stopping of the engine by just operating a vehicle switch. Physical operation of the vehicle key is not necessary. The one-push engine start system 24 will now be described. The vehicle 1 includes an engine ECU 26 that executes ignition control and fuel injection control on an engine 25, a gearshift ECU 27 that controls automatic transmission according to the operation of a gearshift lever, and a power supply ECU 28 that executes power supply management for in-vehicle electrical components. The ECUs 26 to 28 are connected to various ECUs including the verification ECU 5 through the in-vehicle LAN 13.

An engine switch 29, which is operated when switching the power supply state of the vehicle 1, is arranged near the driver's seat in the vehicle 1. The engine switch 29 is of a push-operation type and includes a switch portion 29*a* that is push. The engine switch 29 is connected to the power supply ECU 28 by a harness. The engine switch 29 has an engine starting and stopping operation function, which switches the engine 25 to a started state or a stopped state, and a power supply transition operation function, which switches the power supply state of the vehicle 1 to an OFF state, an ACC ON state, or an IG ON state.

The power supply ECU 28 is connected to a vehicle speed sensor 30, which detects the traveling speed of the vehicle 1, and a brake sensor 31, which detects the depression amount of the brake pedal. The power supply ECU 28 recognizes the current traveling speed of the vehicle 1, which is based on the vehicle speed information from the vehicle speed sensor 30, and determines depression of the brake pedal, which is based on the pedal depression amount information from the brake sensor 31. The power supply ECU 28 is connected to an ACC relay 32, which is connected to various in-vehicle accessories, an IG relay 33, which is connected to the engine ECU 26, and a starter relay 34, which is connected to a starter motor of the engine 25.

After the vehicle exterior verification is completed and the door is unlocked, the verification ECG 5 recognizes with a courtesy switch 35 that the driver is entering the vehicle as the door opens. The verification ECU 5 forms the vehicle interior communication area in the entire vehicle interior by transmitting the request signal Srq to the vehicle interior LF transmitter 7. When receiving the ID signal Sid in response from the portable device 3, which is located in the vehicle interior communication area, with the RF receiver 8 (vehicle interior verification), the verification ECU 5 verifies the ID code of the portable device 3 contained in the ID signal Sid with the ID code registered in the verification ECU 5. The verification ECU 5 sets a vehicle interior verification completion flag in the memory 23 when the vehicle interior verification is completed.

When the driver pushes the engine switch 29 to switch the power supply state of the vehicle 1, the power supply ECU 28 first checks the verification ECU 5 and determines whether the vehicle interior verification has been completed. The power supply ECU 28 recognizes that the vehicle interior verification has been completed when notified by the verification ECU 5 that the vehicle interior verification has been completed. When notified by the verification ECU 5 that the vehicle interior verification has not been satisfied, the power supply ECU 28 instructs the verification ECU 5 to re-execute the vehicle interior verification and re-check whether the vehicle interior verification has been completed. The power supply ECU 28 continues to determine that the vehicle interior verification has not been completed even after the verification ECU 5 re-executes the vehicle interior verification unless notified by the verification ECU 5 that the vehicle interior verification has been completed.

When the engine switch 29 is pushed in a state in which the brake pedal is depressed and the engine 25 is stopped, the power supply ECU 28 activates the three relays 32 to 34 to start the engine 25 as long as the vehicle interior verification is satisfied and then outputs an activation signal to the engine ECU 26. When receiving the activation signal, the engine ECU 26 checks the result of the vehicle interior verification and then checks whether the verification ECU 5 and the engine ECU 26 are a proper pair by performing pairing through encryption communication. If the two conditions are satisfied, the engine ECU 26 initiates the ignition control and the fuel injection control to start the engine 25. In a state in which the vehicle 1 stops moving (vehicle speed "0") and the engine switch 29 is pushed while the engine 25 is still running, the power supply ECU 28 deactivates all of the three relays 32 to 34 to stop the engine 25.

When the engine switch 29 is pushed but the brake pedal is not depressed in a situation in which the conditions are met of the engine 25 being stopped, the vehicle interior verification being completed, and the gearshift lever being at the P range position, the power supply ECU 28 sequentially shifts the power supply state in a manner of OFF state→ACC ON state→IG ON state→OFF state whenever the engine switch 29 is pushed. In the above situation, the power supply state of the vehicle 1 is switched from the OFF state to the ACC state when the engine switch 29 is pushed once. From this state, the power supply state of the vehicle 1 is switched to the IS ON state when the engine switch 29 is pushed again once. From this state, the power supply state of the vehicle 1 returns to the OFF state when the engine switch 29 is pushed again once.

The vehicle 1 includes an immobilizer system 36 for performing wireless ID verification using a communication tag component incorporated in the portable device 3. The immobilizer system 36 includes an immobilizer ECU 37. The immobilizer ECU 37 includes a CPU and a memory and is connected to the in-vehicle LAN 13. The immobilizer ECU 37 is connected to a transponder key coil 38, which functions as a vehicle antenna for the immobilizer system 36. The transponder key coil 38 is wound around a switch portion 29*a* in the housing of the engine switch 29. The portable device 3 incorporates a transponder (also referred to as communication tag component) for transmitting the unique ID code number.

The immobilizer system 36 will now be described. A drive radio wave Siv is transmitted from the transponder key coil 38 by arranging the portable device 3 near the transponder key coil 38. The drive radio wave Siv activates a transponder 39 in the portable device 3 so that the portable device 3 returns a transponder code signal Str in response. The immobilizer ECU 37 performs ID verification (immobilizer verification) on a code number included in the transponder code signal Str. To start the engine 25 by pushing the engine switch 29, completion of the vehicle interior verification is checked as an authentication operation. When conducting this check, there may be a condition in which the key operation-free system 2 is used and the ID verification is completed (vehicle interior verification is completed) or in which the ID verification is completed when using either the key operation-free system 2 or the immobilizer system 36.

Figure 2:
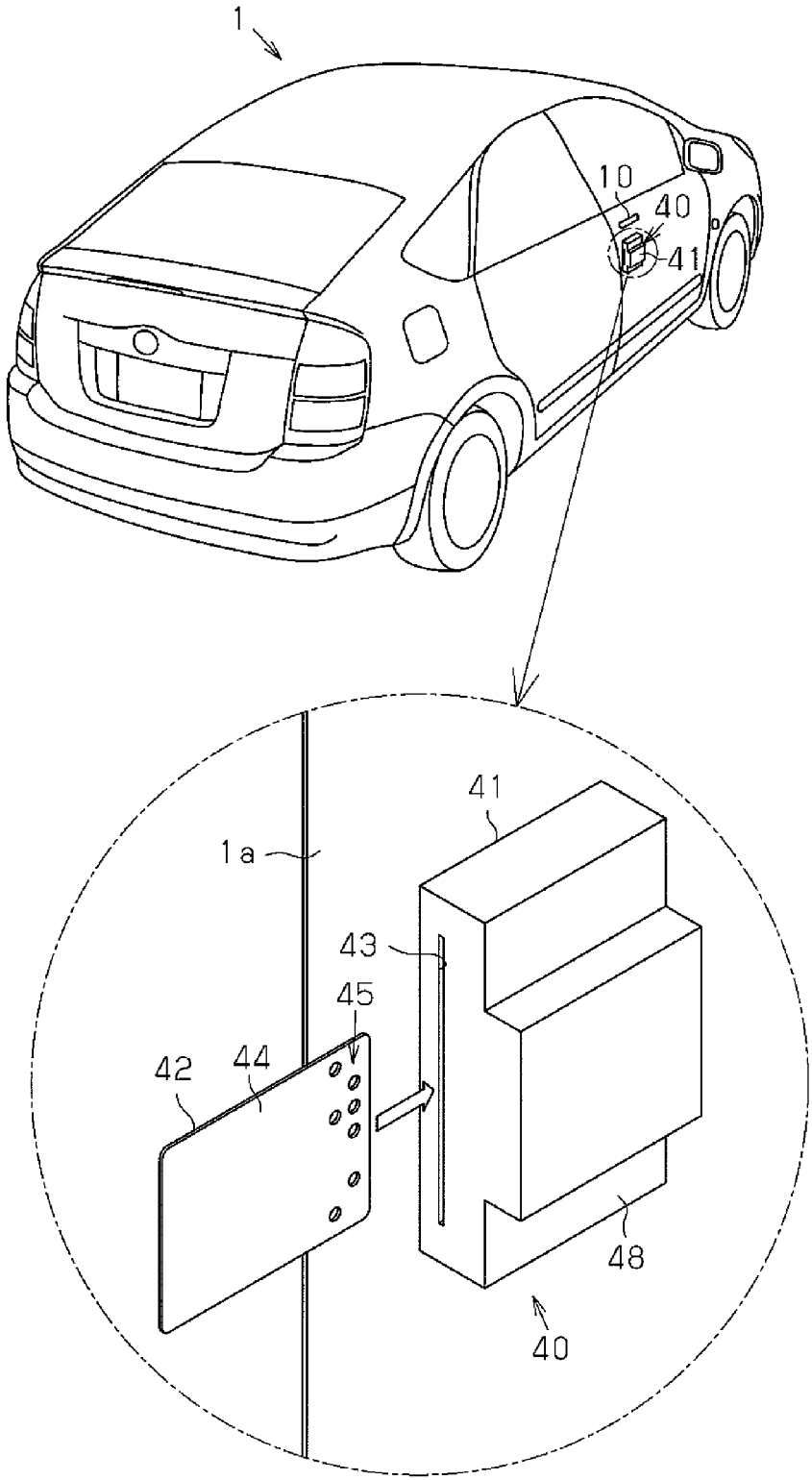
FIG. 2 is a perspective view of a lock apparatus and a card key for a mechanical operation type door lock system.

A mechanical operation type door lock system 40 illustrated in FIG. 2 will now be discussed. The mechanical operation type door lock system 40 is advantageous when a physical key operation with a mechanical key becomes necessary to lock or unlock the doors. Since the smart entry system 4 is of an electrical type, a door cannot be locked or unlocked by the smart entry system 4 if the smart entry system 4 fails to function or if battery drainage occurs in the portable device 3. The mechanical operation type door lock system 40 is used to enable the locking and unlocking of the doors under such situation.

The mechanical operation type door lock system 40 includes a lock apparatus 41, which is attached to an outer wall of the vehicle door (driver's seat door) 1*a*, and a mechanical key 42. The mechanical key 42 is inserted into the lock apparatus 41 and physically operated to open (unlock state) or close (lock state) the lock apparatus 41. In the preferred embodiment, the mechanical key 42 is of a card type (flat plate-shape) and is thus also referred to as the card key 42. The mechanical operation type door lock system 40 may be referred to as card key type door lock system. In a state in which the proper card key 42 is inserted into a key insertion hole 43 of the lock apparatus 41, the door is locked by moving the card key 42 from the initial position in a first direction (e.g., upward direction). In a state in which the proper card key 42 is inserted into the key insertion hole 43 of the lock apparatus 41, the door is unlocked by moving the card key 42 from the initial position in a second direction (e.g., downward direction). The lock apparatus 41 is one example of a tumbler-type lock apparatus, and the card key 42 is one example of a tumbler-type key.

The mechanical operation type door lock system 40 is used during an emergency such as when the smart entry system 4 fails to function or when battery drainage occurs in the portable device 3. The card key 42 is used as an emergency key during such an emergency. The card key 42 is flat and has a size similar to that of a typical credit card. Thus, the card key 42 can be carried in a wallet, a card case, and the like in the same manner as credit cards.

Figure 3:
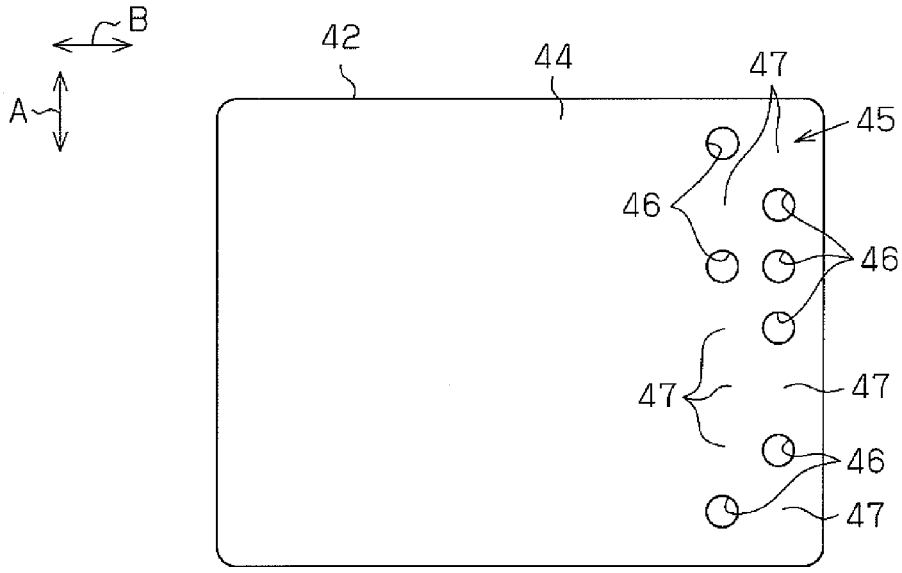
FIG. 3 is a plan view of the card key.

As illustrated in FIG. 3, a key body 44 (also referred to as case portion) of the card key 42 has a code pattern region 45. One or more holes 46 and one or more non-hole portions 47 are formed in the code pattern region 45. The array (pattern) of the holes 46 and the non-hole portions 47 in the code pattern region 45 expresses the key code for the mechanical key of the mechanical operation type door lock system 40. The holes 46 and the non-hole portions 47 are formed in the code pattern region 45 in the directions of arrows A and B of FIG. 3. In the example illustrated in FIG. 3, there are a total of fourteen (seven in each of the two rows) holes 46 and non-hole portions 47. The total number of the holes 46 and non-hole portions 47 is not limited to fourteen and may be changed in accordance with the required security level, the key and lock apparatus dimensions, cost, and the like. The code pattern region 45 is arranged near the distal end of the key body 44. Each hole 46 can be a round through hole, such as a punched hole, extending through the key body 44 but it does not necessary have to be round.

As illustrated in FIGS. 4 to 8, the lock apparatus 41 includes a slider case 48. The slider case 48 is the body portion of the lock apparatus 41 and is box-shaped. The key insertion hole 43 (see FIG. 2) is formed in a side wall of the slider case 48. The slider case 48 is attached to the outer wall of the vehicle door 1*a*. A slider 49 is accommodated in an accommodating space 48*a* of the slider case 48 so as to be movable (linearly movable) relative to the slider case 48. The slider 49 is formed by a plate. The slider 49 is movable in an R1 direction (FIG. 6) and an R2 direction (FIG. 7) in the accommodating space 48*a* of the slider case 48. The slider case 48 is one example of a support member. The slider 49 is one example of a movable member. The slider case 48 may be referred to as fixed side of the lock apparatus 41, and the slider 49 may be referred to as a movable side of the lock apparatus 41.

A plurality of pin tumblers 50 are arranged between the slider case 48 and the slider 49 to fix the slider 49 to the slider case 48 and disable the locking and unlocking operation when the proper card key 42 is not used. The plurality of pin tumblers 50 each face one of the holes 46 or the non-hole portions 47 when the card key 42 is inserted into the lock apparatus 41. Thus, the number of pin tumblers 50 is the same as the total number of the holes 46 and non-hole portions 47 of the card key 42. The pin tumblers 50 is one example of tumbler members.

Each pin tumbler 50 includes a plunger pin 52, which is movably accommodated in a case side accommodation hole 51 formed in the slider case 48, and a lock pin 54, which is movably accommodated in a slider side accommodation hole 53 formed in the slider 49. The pin tumbler 50 is constantly biased toward the slider 49 by a tumbler spring 55 accommodated in the case side accommodation hole 51. The lock pin 54 is longer than the plunger pin 52. The lock pin 54 has a distal end of the lock pin 54 formed by a round surface, for example, a semispherical surface. The tumbler springs 55 is one example of biasing members.

The pin tumbler 50 includes one or more first pin tumblers 50*a*, in which the lock pin 54 is short, and one or more second pin tumblers 50*b*, in which the lock pin 54 is long.

Figure 4:
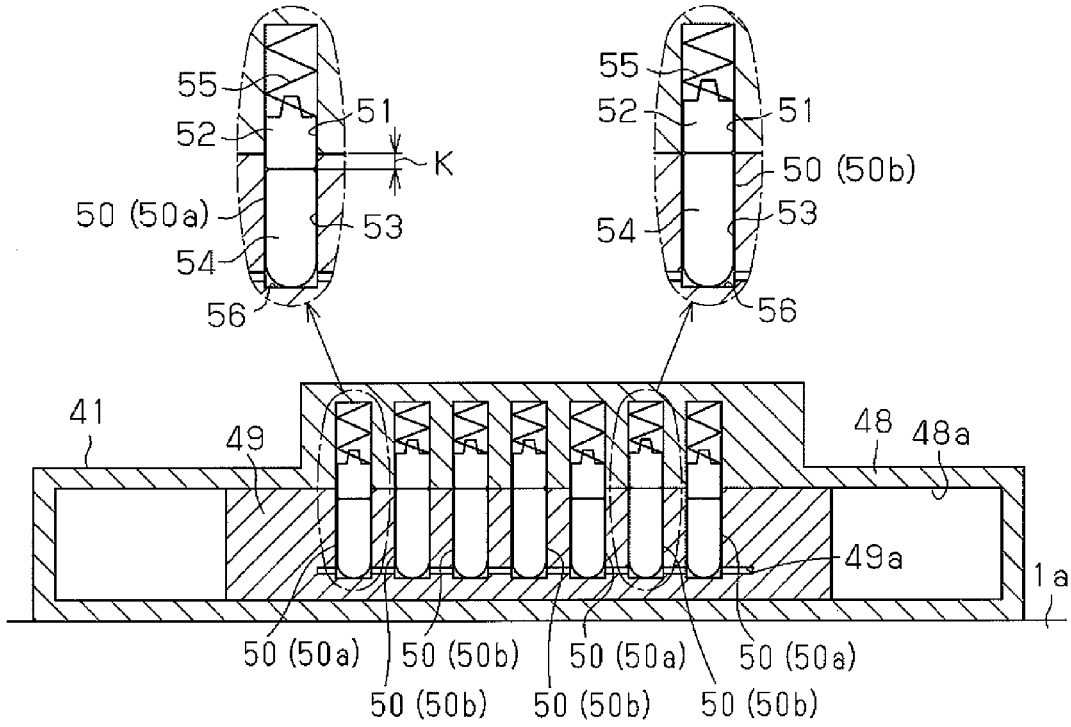
FIG. 4 is a cross-sectional view of the lock apparatus without the card key.
Figure 5B:
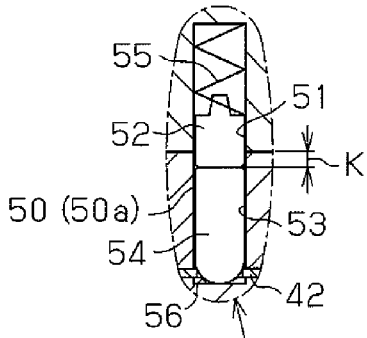
FIG. 5(*a*) is a cross-sectional view of the lock apparatus together with a proper card key, and FIGS. 5(*b*) and 5(*c*) are partial enlarged views of the lock apparatus together with an improper card key.
Figure 5C:
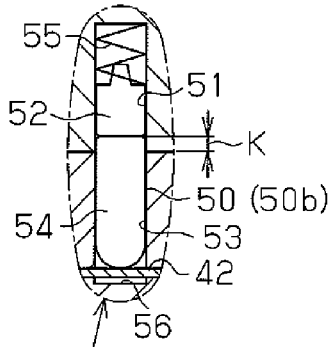
Figure 5A:
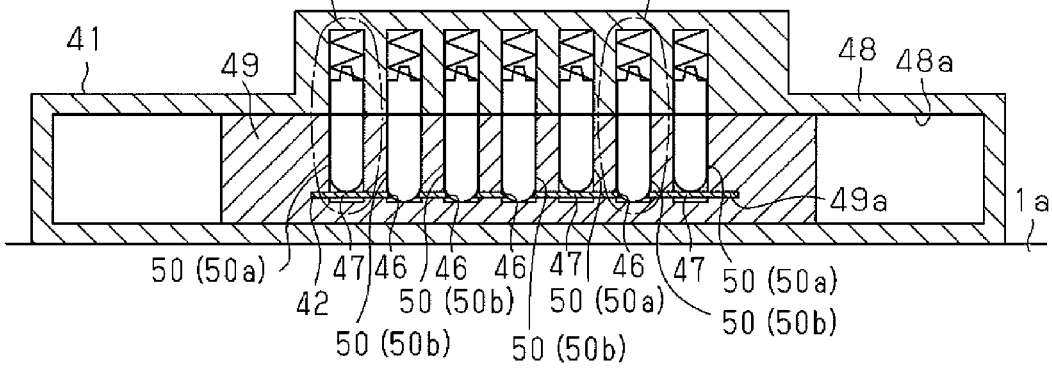

The first pin tumblers 50*a* are located at positions corresponding to the non-hole portions 47 of the proper card key 42 that is inserted into the lock apparatus 41. When the card key 42 is not inserted to the lock apparatus 41 as illustrated in the state of FIG. 4 or when the first pin tumblers 50*a* are forced into the holes 46 of an improper card key 42 as illustrated in the state of FIG. 5(*b*), the plunger pin 52 of each first pin tumbler 50*a* engages both the slider case 48 and the slider 49 over a constant engagement length K (pin tumbler engagement state) and restricts movement of the slider 49. When the proper card key 42 is inserted into the lock apparatus 41 as illustrated in the state of FIG. 5(*a*), the first pin tumblers 50*a* are moved upward by an amount corresponding to the engagement length K against the biasing force of the corresponding tumbler springs 55 by the non-hole portion 47 of the card key 42. The shear line between the plunger pin 52 and the lock pin 54 of each first pin tumbler 50*a* (shear line between the two components of the plunger pin 52) becomes aligned with the shear line between the slider case 48 and the slider 49 (slide surface of the slider 49) (pin tumbler disengagement state). The first pin tumblers 50*a* in the pin tumbler disengagement state do not function to restrict movement of the slider 49.

The second pin tumblers 50*b* are located at position corresponding to the holes 46 of the proper card key 42 that is inserted into the lock apparatus 41. When the card key 42 is not inserted into the lock apparatus 41 as illustrated in the state of FIG. 4 or when the second pin tumblers 50*b* are forced into the holes 46 of the proper card key 42 as illustrated in FIG. 5(*a*), the shear line between the plunger pin 52 and the lock pin 54 of each second pin tumbler 50*b* is aligned with the shear line between the slider case 48 and the slider 49 (pin tumbler disengagement state). The second pin tumblers 50*b* in the pin tumbler disengagement state do not function to restrict movement of the slider 49. When an improper key is inserted into the lock apparatus 41 as illustrated in the state of FIG. 5(*c*), the second pin tumblers 50*b* are forced upward against the biasing force of the corresponding tumbler springs 55 by the non-hole portions 47. The second pin tumblers 50*b* engage both the slider case 48 and the slider 49 (pin tumbler engagement state) and restrict movement of the slider 49. The lifted amount of each second pin tumbler 50*b* is the engagement length K of the lock pin 54 in each second pin tumbler 50*b*.

Figure 6:
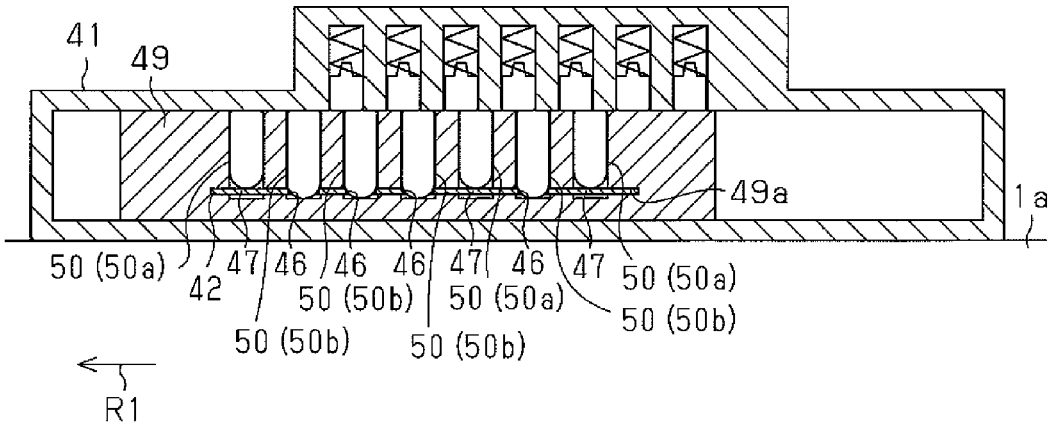
FIG. 6 is a cross-sectional view of the lock apparatus when opened by the card key.
Figure 7:
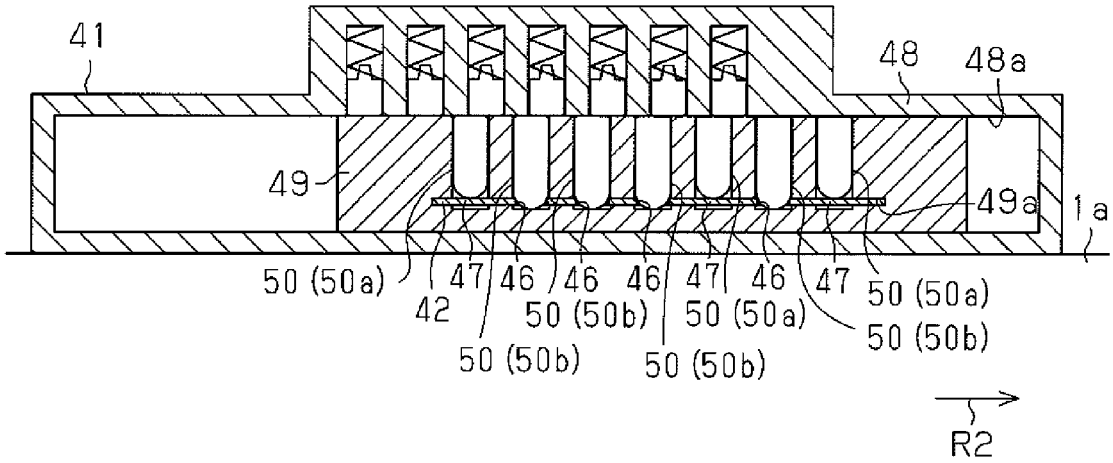
FIG. 7 is a cross-sectional view of the lock apparatus when closed by the card key.
Figure 8:
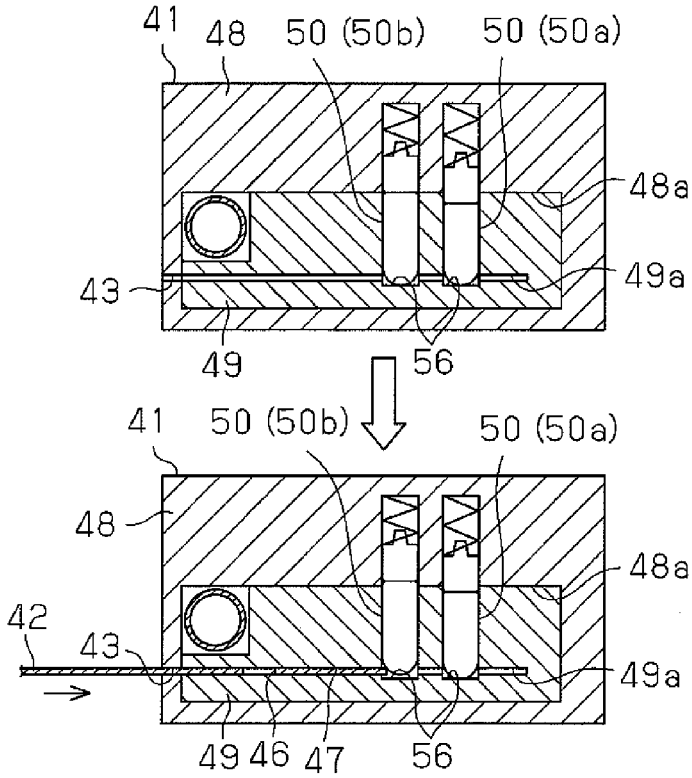
FIG. 8 is a cross-sectional view of the lock apparatus showing states before and during insertion of the card key.

The slider 49 is connected to a dead bolt (not illustrated) or the door lock member of the vehicle door 1*a* by a transmission mechanism (not illustrated). The transmission mechanism transmits and converts the movement of the slider 49 to the mechanical opening and closing of the dead bolt. Referring to FIGS. 7 and 8, when the card key 42 is inserted to the lock apparatus 41, the slider 49 becomes movable in two directions from a neutral position. When the slider 49 is moved in one direction (direction of arrow R1 in FIG. 6) from the neutral position, the transmission mechanism converts the movement of the slider 49 to a projection operation of the dead bolt to lock the vehicle door 1*a*. When the slider 49 is moved in the other direction (direction of arrow R2 in FIG. 7) from the neutral position, the transmission mechanism converts the movement to a retraction operation of the dead bolt to unlock the vehicle door 1*a*.

As illustrated in FIGS. 4 to 8, the slider 49 has a key slot 49*a*, which is in communication with the key insertion hole 43. The key slot 49*a* has a surface that comes into contact with the distal ends of the pin tumblers 50. This surface includes a plurality of pin accommodation recesses 56. The distal ends of the pin tumbler 50 (lock pin 54) are accommodated in the corresponding pin accommodation recess 56. Each pin accommodation recess 56 functions to increase the lifted amount of the corresponding pin tumbler 50 and increases the engagement length K of the pin tumbler 50. Further, each pin accommodation recess 56 has a depth from the key slot 49*a* that is determined to maximize the engagement length K with a range in which the edge of the card key 42 can enter the gap under the distal end of the lock pin 54 when the card key 42 is inserted into the lock apparatus 41. The depth of the pin accommodation recess 56 is determined so that part of the semispherical distal end of the lock pin 54 is exposed from the pin accommodation recess 56. The pin accommodation recess 56 is one example of an accommodation portion.

The relationship of the pin accommodation recesses 56 and the key slot 49*a* is such that the key slot 49*a* is spaced apart from the bottom of each pin accommodation recess 56 (seat surface that receives the distal end of the corresponding pin tumbler 50) toward the shear line between the slider 49 and the slider case 48. In other words, the key slot 49*a* extends in the slider 49 at an intermediate height between the bottom of each pin accommodation recess 56 and the shear line between the slider 49 and the slider case 48.

The operation of the mechanical operation type door lock system 40 will now be discussed.

When a driver tries to enter the vehicle 1, which is in a parked state (engine stopped, door locked state), if the key operation-free system 2 fails to function or if battery drainage occurs in the portable device 3, the doors cannot be unlocked with the key operation-free system 2. In such a case, the driver unlocks the vehicle door 1*a* with the mechanical operation type door lock system 40. The driver may carry the card key 42 of the mechanical operation type door lock system 40 in a wallet, a card case, or the like. The driver inserts the card key 42 into the key insertion hole 43 of the lock apparatus 41. The slider 49 is at the neutral position when the card key 42 is inserted into the lock apparatus 41.

As illustrated in the state of FIG. 4, when the card key 42 is not inserted into the lock apparatus 41, the second pin tumblers 50*b* are in the pin tumbler disengagement state. However, the first pin tumblers 50*a* are in the pin tumbler engagement state. The first pin tumblers 50*a* restrict movement of the slider 49 relative to the slider case 48. Thus, the slider 49 cannot be moved even when a person inserts his or her fingers into the key insertion hole 43 of the lock apparatus 41 to forcibly move the slider 49. In this manner, unauthorized opening and closing of the lock apparatus 41 is prevented.

When inserting the card key 42 into the key insertion hole 43, the edge of the card key 42 enters the gap below the distal ends of the pin tumblers 50 and thereby lifts the pin tumbler 50, as illustrated in the state of FIG. 8. When the card key 42 is completely inserted into the key insertion hole 43, the pin tumblers 50 of the lock apparatus 41 faces the corresponding holes 46 and non-hole portions 47 of the card key 42. If the card key 42 is a proper key, the non-hole portions 47 of the card key 42 are located at positions corresponding to the first pin tumblers 50*a*, and the holes 46 of the card key 42 are located at positions corresponding to the second pin tumbler 50*b*, as illustrated in the state of FIG. 5(*a*).

If the card key 42 is a proper key, each first pin tumbler 50*a* is forced upward by a distance corresponding to the sum of the plate thickness of the card key 42 and the depth of the pin accommodation recess 56 by the corresponding non-hole portion 47 of the card key 42 against the biasing force of the tumbler spring 55. The shear line between the plunger pin 52 and the lock pin 54 of the first pin tumbler 50*a* is aligned with the shear line between the slider case 48 and the slider 49 (pin tumbler disengagement state). The second pin tumbler 50*b* is fitted into the corresponding hole 46 of the card key 42 and thus forced towards the slider 49 by the tumbler spring 55, and the shear line between the plunger pin 52 and the lock pin 54 of the second pin tumbler 50*b* is aligned with the shear line between the slider case 48 and the slider 49 (pin tumbler disengagement state).

The first pin tumbler 50*a* and the second pin tumbler 50*b* are in the pin tumbler disengagement state. Thus, the lock apparatus 41 is in a slider movable state in which the slider 49 is movable relative to the slider case 48. The slider 49 can be moved from the neutral position with the card key 42 when the lock apparatus 41 is in the slider movable state. Therefore, if the proper key 42 is inserted into the lock apparatus 41 and moved in one direction (direction of arrow R1 of FIG. 6) to move the slider 49 in that direction (as illustrated in the state of FIG. 6), such movement is transmitted to the dead bolt by the transmission mechanism. This retracts the dead bolt from a projected state and unlocks the vehicle door 1*a*.

The plunger pin 52 and the lock pin 54 of every one of the pin tumblers 50 must be facing toward each other to enable upward and downward movements of the pin tumblers 50. That is, the card key 42 cannot be taken out from the lock apparatus 41 unless the plunger pin 52 and the lock pin 54 of each pin tumblers 50 are facing each other. Therefore, after unlocking the vehicle door 1*a*, the driver returns the card key 42 to the initial position by moving the slider 49 to the neutral position to remove the card key 42 from the lock apparatus 41. The driver then pulls out the card key 42 from the lock apparatus 41 and enters the vehicle while holding the card key 42. The driver performs card key operations in this manner to enter the vehicle.

When locking the vehicle door la with the mechanical operation type door lock system 40, the proper card key 42 is inserted into the lock apparatus 41 in which the slider 49 is located at the neutral position. Then, the driver moves the card key 42 in the other direction (direction of arrow R2 of FIG. 7) to move the slider 49 in the other direction (state illustrated in FIG. 7). In this case, the movement of the slider 49 is transmitted to the dead bolt by the transmission mechanism. This projects the dead bolt from the retracted state to lock the vehicle door 1*a*. When removing the card key 42 from the lock apparatus 41 after locking the vehicle door 1*a*, the driver returns the card key 42 to the initial position by moving the slider 49 to the neutral position. Then, the driver pulls out the card key 42 from the lock apparatus 41 in the same manner as when unlocking the vehicle door 1*a* with the lock apparatus 41.

Figure 9:
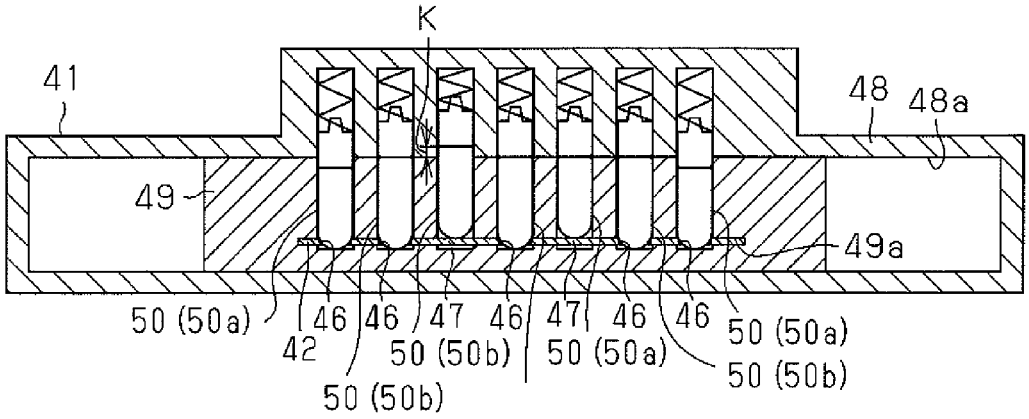
FIG. 9 is a cross-sectional view of the lock apparatus with an improper card key.

A case in which an improper key is inserted into the lock apparatus 41 will now be discussed. The improper code key is a card key in which the array of the holes 46 and non-hole portions 47 is not in correspondence with the key code of the proper card key 42. If the improper key is inserted to the lock apparatus 41, as illustrated in the state of FIG. 9, the holes 46 of the card key 42 may be located at positions facing toward some of the first pin tumblers 50*a*. Further, the non-hole portions 47 of the card key 42 may be located at positions facing toward some of the second pin tumblers 50*b*.

The first pin tumblers 50*a* are each fitted into the corresponding hole 46 and forced towards the slider 49 by the biasing force of the tumbler spring 55 when facing toward the hole 46 of the card key 42. Thus, the first pin tumbler 50*a* shifts to the pin tumbler engagement state in which the plunger pin 52 is engaged to both the slider case 48 and the slider 49 over the engagement length K. This restricts movement of the slider 49 relative to the slider case 48. The engagement length K in this case corresponds to the lifted amount of the plunger pin 52 if a non-hole portion 47 were to face toward a first pin tumbler 50*a* when inserting the card key 42 into the lock apparatus 41. That is, the engagement length K corresponds to the distance of the sum of the plate thickness of the card key 42 (non-hole portion 47) and the depth of the pin accommodation recess 56.

Further, when each of the second pin tumblers 50*b* is located at a position facing toward a non-hole portion 47 of the card key 42, the non-hole portion 47 forces the second pin tumblers 50 upward by a distance corresponding to the sum of the plate thickness of the card key 42 and the depth of the pin accommodation recess 56 against the biasing force of the tumbler spring 55. Thus, the second pin tumbler 50*b* is in the pin tumbler engagement state in which the lock pin 54 engages both the slider case 48 and the slider 49 over the length forced upward by the non-hole portion 47 of the card key 42 as the engagement length K. This restricts movement of the slider 49 relative to the slider case 48.

Therefore, when one or more of the pin tumblers 50 are in the pin tumbler engagement state, the slider 49 cannot move relative to the slider case 48. Such a state is referred to as a slider immovable state of the lock apparatus 41. The slider 49 cannot be moved from the neutral position using the card key 42 that is inserted into the lock apparatus 41 when the lock apparatus 41 is in the slider immovable state. Thus, the locking and unlocking of the vehicle door 1*a* cannot be performed if the card key 42 that is inserted into the lock apparatus 41 is an improper key.

Figure 10:
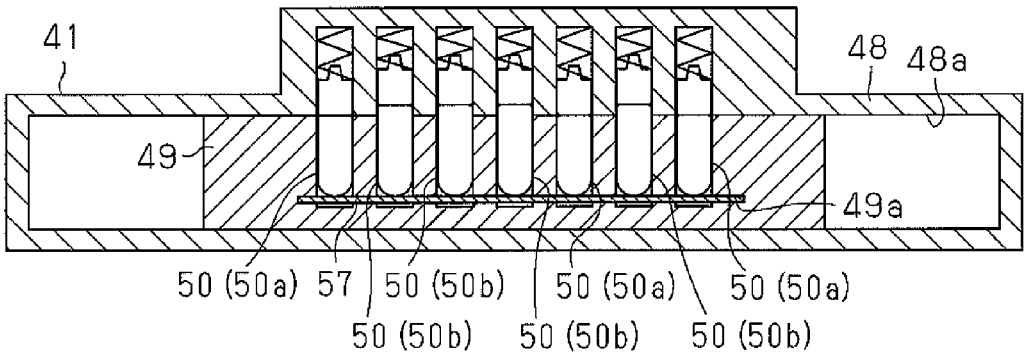
FIG. 10 is a cross sectional view of the lock apparatus with a plate having no holes.

An example of an unauthorized key operation in which a plain plate member 57 is inserted into the lock apparatus 41 to forcibly move the slider 49 and attempt unauthorized opening or closing of the lock apparatus 41 will now be discussed with reference to FIG. 10. If the plain plate member 57 is inserted to the lock apparatus 41, the plate member 57 force both the first pin tumblers 50*a* and the second pin tumblers 50*b* upward against the biasing force of the tumbler springs 55. The first pin tumblers 50*a* shifts to the pin tumbler disengagement state with the shear line between the plunger pin 52 and the lock pin 54 aligned with the shear line between the slider case 48 and the slider 49. However, the second pin tumblers 50*b* are in the pin tumbler engagement state in which the lock pins 54 are engaged with the slider case 48 and the slider 49.

If the plain plate member 57 is inserted into the lock apparatus 41 as an unauthorized, or improper, key to perform an unauthorized, or improper, key operation, the second pin tumblers 50*b* function to fix the slider 49 to the slider case 48. Thus, the second pin tumblers 50*b* shift the lock apparatus 41 to a slider immovable state. In this manner, even if a third person attempts to perform an unauthorized key operation by inserting the plain plate member 57 into the lock apparatus 41 to forcibly move the slider 49, movement of the slider 49 is disabled. As a result, the lock apparatus 41 does not open when performing an unauthorized key operation with this type of plate member 57 in the same manner as when using an improper key.

In the preferred embodiment, the slider 49 includes the pin accommodation recesses 56 for partially accommodating the distal ends of the pin tumblers 50. This increases the movement amount of the pin tumbler 50. The engagement length K of the pin tumbler 50 increases in accordance with the movement amount of the pin tumbler 50. Thus, in the preferred embodiment, the lock strength of the pin tumbler 50 is increased. This further contributes to resisting improper operations of the lock apparatus 41.

If a third person attempts to improperly move the slider 49, the engagement length K, which is longer than in that in the prior art, increases the external force required for forcible disengagement of the pin tumblers 50. This results in improper movement the slider 49 becoming difficult. The lock apparatus 41, which is difficult to open in an improper manner, is advantageous when used in combination with the electronic key system as a vehicle antitheft device.

The configuration of the present embodiment has the following advantages.

(1) A pin accommodation recess 56 for accommodating part of the distal end of each pin tumbler 50 is formed in the key slot 49*a* of the slider 49 in the surface which the distal end position of the pin tumbler 50 contacts. The upward and downward movement amount of each pin tumbler 50 thus includes the depth of the pin accommodation recess 56 in addition to the thickness of the card key 42. Thus, the upward and downward movement amount of the pin tumbler 50 is increased by forming pin accommodation recesses 56 in the lock apparatus 41. Further, the longer engagement length K of each pin tumbler 50 with the slider case 48 and the slider 49 increases the lock strength of the pin tumbler 50. Therefore, the slider 49 is fixed to the slider case 48 with lock strength of a high level. This further resists improper locking and unlocking operations of the lock apparatus 41.

(2) The card key 42 includes in the code pattern region 45 a key code expressed by the existence and non-existence of holes 46 formed in the card material (plate material). The holes 46 may be replaced with recesses having closed bottoms when forming the key code in the card key 42. However, such a card key 42 would have to be thicker to provide sufficient depths for bottomed recess. Such a thick card key is not preferable. The card key 42 of the preferred embodiment is thin since the holes 46 extend through the card key 42.

(3) The engagement length K is not dependent on the thickness of the card key. Thus, the lock strength of the lock apparatus 41 is larger than the prior art even though a thin card key is used. The card key 42 may be accommodated in a small space in a wallet or the like. Thus, the card key 42 may be easily carried.

(4) The card key 42 is used as an emergency key for the key operation-free system 2, and a mechanical key does not need to be accommodated in the portable device 3 as an emergency key. The emergency key can thus be omitted from the portable device 3, and the portable device 3 can be miniaturized by the omission of the mechanical key.

It should be apparent to those skilled in the art that the present invention may be embodied in many other specific forms without departing from the spirit or scope of the invention. Particularly, it should be understood that the present invention may be embodied in the following forms.

Figure 11:
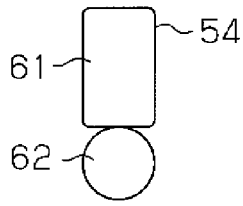
FIG. 11 is a front view of a lock pin and an auxiliary member.
Figure 12:
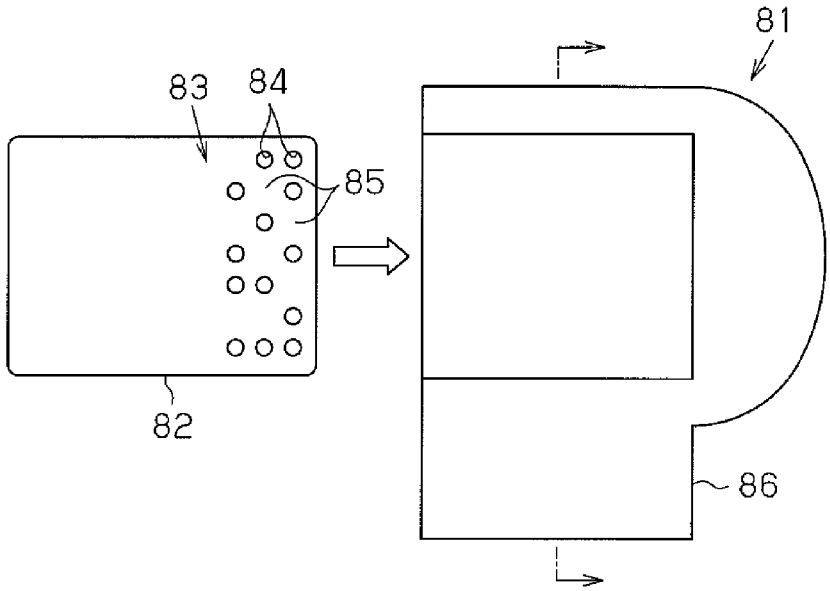
Fig.12(Prior Art)
FIG. 12 is a plan view of a lock apparatus before insertion of a card key in the prior art.
Figure 13:
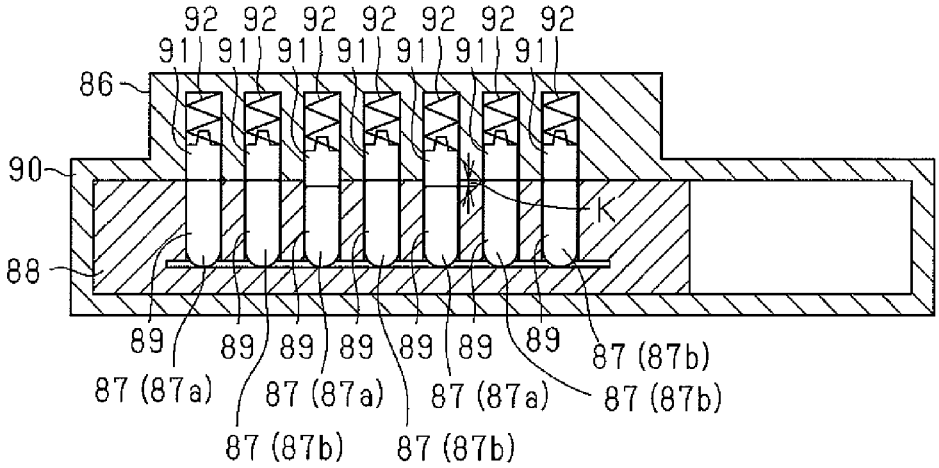
Fig.13(Prior Art)
FIG. 13 is a cross-sectional view of the lock apparatus illustrated in FIG. 12.
Figure 14:
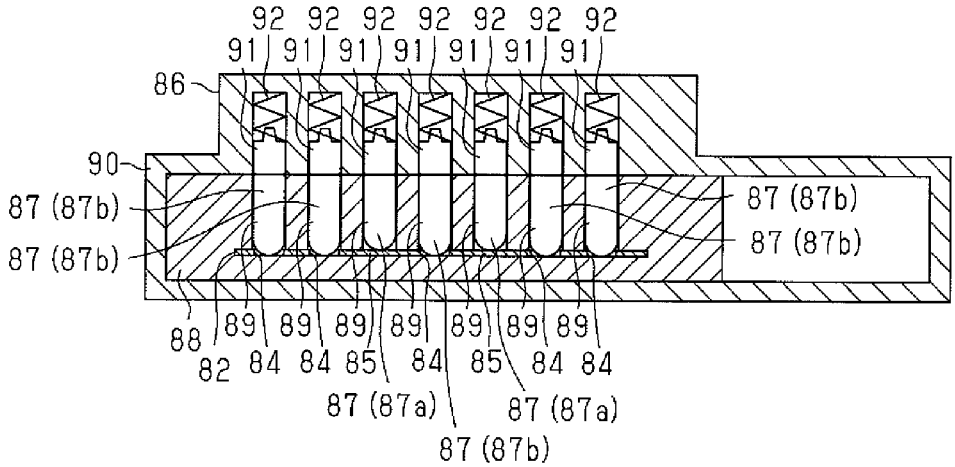
Fig.14(Prior Art)
FIG. 14 is a cross-sectional view of the lock apparatus with a proper card key in the prior art.
Figure 15:
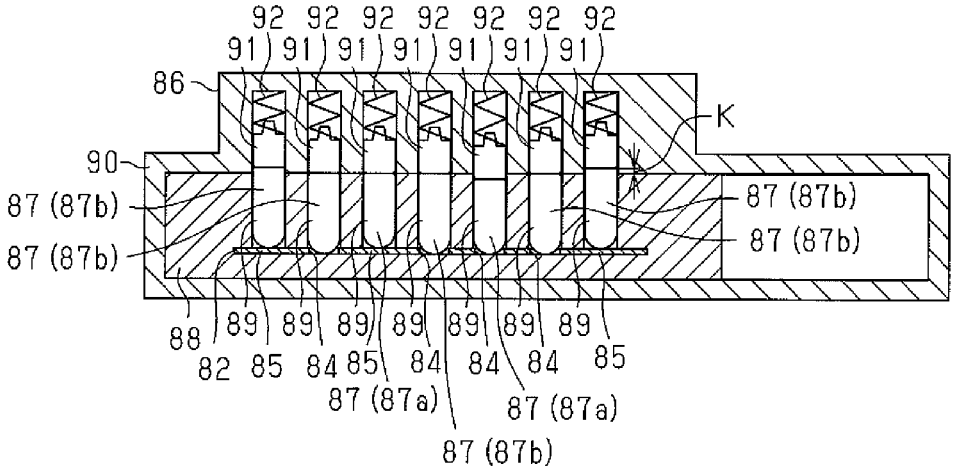
Fig.15(Prior Art)
FIG. 15 is a cross-sectional view of the lock apparatus with an improper card key in the prior art.

The lock pin 54 of the pin tumbler 50 does not have to be a single component and may be formed from a plurality of components as illustrated in FIG. 11. In this case, the lock pin 54 includes a cylindrical body portion 61 and a distal end pin 62, which is a component separate from the body portion 61 and which contacts the card key 42. The distal end pin 62, which functions to enable smooth insertion of the card key 42 into the lock apparatus 41, is round and may be spherical or cylindrical. The distal end pin 62 may be rotated when inserting the card key 42 into the lock apparatus 41 or when removing the card key 42 from the lock apparatus 41. If the pin tumbler 50 includes the distal end pin 62, the card key 42 may be smoothly inserted to the lock apparatus 41 so as to reduce resistance during card insertion. The distal end pin 62 can be a ball or a roller. The distal end pin 62 is one example of an auxiliary member.

The mechanical key of the mechanical operation type door lock system 40 is not limited to a card key 42, which is extremely thin and plate-shaped like a credit card. The mechanical key may be thicker but smaller than a credit card, in the same manner as a memory card. In this case, the card key 42 may be accommodated in a memory card slot of the portable device of the like. The mechanical key of the mechanical operation type door lock system 40 is not limited to a key body of a card shape and may have a key shape having a slight thickness. The mechanical key may be thinner than a credit card as long as operation of the lock apparatus 41 is possible and may have a thickness that allows flexible bending.

The lock apparatus 41 is not limited to a structure for manually moving the slider 49 with the card key 42. An electrical structure of detecting the pin tumbler disengagement state of all the pin tumblers with a sensor and moving the slider 49 with the power of the motor and the like may be adopted.

The lock apparatus 41 is not limited to a slide type in which the movable member (slider 49) linearly slides and may be a rotatable type in which the movable member is rotated by a key.

The biasing member for biasing each pin tumbler 50 is not limited to a spring and may be a rubber material.

The activation of the relays 32 to 34 is not limited to electrical management by a power supply ECU 28 and may be a mechanical type in which the relays are switched between activated and deactivated states by the physical operation of the key.

The lock apparatus 41 is not limited to a pin tumbler type including the pin member, and may be a disk tumbler type in which the tumbler member is plate-shaped.

The card key 42 may be an IC card key in which a transponder is embedded. In this case, the immobilizer verification becomes possible with the card key 42.

The electronic key system is not limited to a key operation-free system 2 in which the locking and unlocking of the door and the starting and stopping of the engine are automatically permitted or executed as long as the driver is carrying the proper portable device 3. A wireless key system in which various operation buttons are formed in the electronic key may be used in which an operation request command and key code are transmitted to the vehicle 1 through wireless communication when such a button is pushed.

The engine starting and stopping system of the vehicle 1 is not limited to a one-push engine start system 24 and may be a mechanical operation engine starting and stopping system in which the mechanical key is inserted into the engine starting and stopping key cylinder and turned to start or stop the engine.

The mechanical operation key system using the card key 42 is not necessarily limited to being used during an emergency of the smart entry system 4 and may be used during an emergency of the one-push engine start system 24. The mechanical operation key system using the card key 42 of the preferred embodiment merely needs to be adopted in at least one of the smart entry system 4 or the one-push engine start system 24.

The mechanical operation type door lock system 40 is not limited to a vehicle 1, and may be used in various components for opening and closing components such as the door of a house and the like.

The pin accommodation recesses 56 can be formed in the slider case 48. In this case, the tumbler springs 55 may be arranged in the slider 49.

The present examples and embodiments are to be considered as illustrative and not restrictive, and the invention is not to be limited to the details given herein, but may be modified within the scope and equivalence of the appended claims.

What is claimed is:

1. A tumbler-type lock apparatus for use with a tumbler-type key having a code pattern region including an array of one or more holes and one or more non-hole portions that expresses a key code of the tumbler-type key, the tumbler-type lock apparatus comprising:

a support member;

a movable member movable relative to the support member when the tumbler-type key is inserted into the tumbler-type lock apparatus;

a plurality of tumblers arranged to extend in the support member and the movable member, the plurality of tumblers each corresponding to one of the one or more holes or one of one or more non-hole portions during insertion of the tumbler-type key; and a plurality of biasing members each biasing a corresponding one of the plurality of tumblers towards the movable member;

wherein the tumbler-type lock apparatus performs verification of the tumbler-type key based on whether the plurality of tumblers are engaged with the support member and the movable member during insertion of the tumbler-type key; and the movable member or the support member includes an accommodation portion for accommodating a distal end of each tumbler that has passed through the corresponding hole of the tumbler-type key.

2. The tumbler-type lock apparatus according to claim 1, further comprising:

an auxiliary member which is arranged at the distal end of the tumbler for reducing resistance when the tumbler-type key is inserted into and removed from a key insertion hole of the lock apparatus.

3. The tumbler-type lock apparatus according to claim 1, wherein:

the tumbler-type lock apparatus is for use with an electronic key system of a vehicle;

the electronic key system includes an electronic key capable of transmitting a key code through wireless communication, the electronic key system permitting or executing operations of the vehicle when the key code of the electronic key is proper, and the vehicle being operable by the operation of an emergency key; and the key code of the tumbler-type key is set as a key code of the emergency key.

4. The tumbler-type lock apparatus according to claim 1, wherein the tumbler-type key is a card key.

5. The tumbler-type lock apparatus according to claim 1, wherein the holes each include a hole extending through the tumbler-type key in a thicknesswise direction.

6. The tumbler-type lock apparatus according to claim 1, wherein:

the movable member or the support member includes a key slot into which the tumbler-type key is inserted;

the accommodation portion includes a bottom which comes into contact with the distal end of the tumbler; and the key slot is formed at a position spaced apart from the bottom of the accommodation portion toward a shear line between the movable member and the support member.

7. A vehicle antitheft device comprising:

an electronic key system; and the tumbler-type lock apparatus according to claim 1 for emergency use.

* * * * *